US005182493A

United States Patent [19]

Robertson

[11] Patent Number: 5,182,493

[45] Date of Patent: Jan. 26, 1993

[54] RISING SUN MAGNETRON WITH PLANAR TUNING MEMBER PROTRUDING INTO ONLY ONE SET OF CAVITIES

[75] Inventor: Mark A. Robertson, Essex, England

[73] Assignee: EEV Limited, Chelmsford, United Kingdom

[21] Appl. No.: 650,618

[22] Filed: Feb. 5, 1991

[30] Foreign Application Priority Data

Feb. 6, 1990 [GB] United Kingdom ..... 90025931

[51] Int. Cl.[5] ..... H01J 25/593

[52] U.S. Cl. ..... 315/39.610; 315/39.65

[58] Field of Search ..... 315/39.51, 39.55, 39.61, 315/39.65, 39.75

[56] References Cited

U.S. PATENT DOCUMENTS

| | | | |
|---|---|---|---|
| 2,418,469 | 4/1947 | Hagstrum | 315/39.75 X |
| 2,424,496 | 7/1947 | Nelson | 315/39.75 X |
| 2,639,407 | 5/1953 | Lamb, Jr. | 315/40 |
| 2,749,477 | 6/1956 | Verweel | 315/39.65 X |
| 2,870,375 | 1/1959 | Verweel | 315/39.51 |
| 3,731,140 | 5/1973 | Lewis | 315/39.55 X |

FOREIGN PATENT DOCUMENTS

| | | |
|---|---|---|
| 730246 | 12/1942 | Fed. Rep. of Germany . |
| 874028 | 4/1953 | Fed. Rep. of Germany . |
| 2104094 | 4/1972 | France . |
| 629902 | 9/1949 | United Kingdom . |
| 709129 | 5/1954 | United Kingdom . |
| 716677 | 10/1954 | United Kingdom . |
| 738926 | 10/1955 | United Kingdom . |
| 1292172 | 10/1972 | United Kingdom . |
| 1297711 | 11/1972 | United Kingdom . |
| 1349354 | 4/1974 | United Kingdom . |

*Primary Examiner*—Paul M. Dzierzynski
*Assistant Examiner*—Benny T. Lee
*Attorney, Agent, or Firm*—Spencer, Frank & Schneider

[57] ABSTRACT

A magnetron having a rising sun anode includes a slot which is extensive in a plane transverse to the axis and in which a tuning member is located. The tuning member may be moved inwardly and outwardly to control the frequency of the magnetron output radiation, the member being arranged such that it can intercept the anode cavities by a variable amount to change their resonant characteristics.

15 Claims, 3 Drawing Sheets

RISING SUN MAGNETRON WITH PLANAR TUNING MEMBER PROTRUDING INTO ONLY ONE SET OF CAVITIES

FIELD OF THE INVENTION

This invention relates to magnetrons and more particularly to magnetrons which are capable of being tuned to vary the frequency of their output radiation.

BACKGROUND OF THE INVENTION

A magnetron includes a cathode and anode arranged coaxially about a longitudinal axis, the anode defining a plurality of resonant cavities. The frequency of radiation generated by the magnetron is principally determined by the dimensions of the resonant anode cavities, especially their length in the axial direction and also, but not to such a significant extent, their radial lengths.

One method which is currently employed to provide frequency tuning involves use of an annular plate arranged over the anode cavities. The plate is vibrated so as to change its distance from the anode and hence alter the resonant frequency characteristics. In another method, prongs are inserted by a variable amount into the cavities to produce perturbations causing the output frequency to change.

SUMMARY OF THE INVENTION

The present invention arose from an attempt to provide a magnetron frequency tuning mechanism which is relatively inexpensive to implement and which permits rapid, accurate changes in output frequencies to be achieved.

According to the present invention there is provided a magnetron comprising: a plurality of larger and a plurality of smaller anode cavities arranged in a rising sun configuration, there being a slot in the anode which is extensive in a plane substantially orthogonal to the longitudinal axis of the anode; and a tuning member movable in the slot so as to enter one or more of only the larger anode cavities by an amount which is variable to vary the frequency of the output radiation. The longitudinal axis is that about which the magnetron anode and cathode are coaxially arranged.

When the tuning member's position in the slot alters, the resonant characteristics of the cavity or cavities it intercepts are changed in accordance with the area of the cavity or cavities intercepted, and the material of which the member consists. The change in the resonant characteristics causes the output frequency to be varied.

By employing the invention, tuning may be achieved whilst experiencing minimal losses in output power because induced currents in the cylindrical anode wall tend to flow in a generally circumferential direction and therefore do not intercept the slot. The slot may be arranged to guide the tuning member within relatively close tolerances thereby enabling it to be moved quickly and accurately to alter the resonant frequency characteristics.

Also, as the slot is arranged orthogonal to the longitudinal axis, the magnetron may be made more compact in the axial direction than would be the case were conventional tuning mechanisms employed which necessitate access to the anode from its ends.

The invention may be applied to anode structures which are open and include strapping, and to closed end anodes.

The invention may be particularly advantageously employed where the anode is of the closed-end type in which conductive end plates are used to define the anode cavities in the radial plane in addition to the usual cavity-defining surfaces in the axial direction so that the only opening in the cavity is that directed towards the cathode. It is sometimes desirable to use such a configuration when the magnetron operates at relatively high frequencies and by using the invention, the advantages of such a design may be obtained whilst still enabling frequency tuning to be implemented.

It may be preferred to locate the slot substantially mid-way along the anode in the axial direction. This is particularly suitable for a closed end anode device because the end plates constrain the voltage distribution such that there is a voltage maximum of the anode centre. However, the slot could be located at other positions along the axis.

The tuning member is preferably of a dielectric material, such as alumina, which lowers the output frequency of the magnetron as it is gradually inserted into the anode cavity. In this case, the dielectric tuning member alters the capacitance when it is moved to produce the change in resonance frequency. The use of a dielectric material is particularly advantageous as leakage is reduced and hence the tolerances required for the fit of the tuning member in the slot need not be so tight as would be necessary with a metal tuning member. Where the tuning member is a metal plate, this acts to raise the frequency as the extent that the member intercepts the anode cavity is increased. Metal tuning members produce a change because of inductive effects, capacitive effects or a combination of these, depending on the position of the slot and tuning member. It has been found that the use of a dielectric tuning member gives good results for a closed-end anode magnetron whereas a metal plate tuning member appears to give greater frequency tuning ranges for an open-end anode device.

The number of the larger anode cavities which may be intercepted by the tuning member when it is moved inwardly to its greatest extent may range from only one to a plurality of cavities. If a larger number of anode cavities are entered by the tuning member, the tuning range is extended compared to that available when only one, for example, can be intercepted.

It may be preferred that the slot be arranged in the part of the anode diametrically opposite means for extracting output radiation from the magnetron. The means may comprise a slot in the anode wall extending in an axial direction or might be for example, a loop by which radiation can be coupled out of the device.

The tuning member may be such that its leading edge which intercepts the larger anode cavity or cavities is straight. Then, for example, one cavity would first of all be intercepted, and then the larger anode cavities to each side of it subsequently entered by the tuning member, as it is moved further inwardly. It may be preferred however to use a tuning member which is curved to give a concave leading edge. This may be arranged to intercept two or more cavities simultaneously at a certain position of travel and to ensure that similar amounts of the tuning member enter each of the intercepted cavities at the same time. The frequency tuning characteristics may be further controlled by varying the radial lengths of the anode cavities around the anode. This may be achieved even in a rising sun configuration by arranging that although the larger cavities may, say, be longer in the radial direction if they are nearer the slot than those further away, that the smaller cavities also change proportionally in size, so as to retain the relationship between the two sizes.

It may be preferred to include a plurality of slots, each slot being extensive in a plane parallel to that in which another of the slots is extensive. Each slot has a tuning member movable therein which is movable to enter at least one of the larger anode cavities by a variable amount. The slots may be arranged at the same distance along the anode in the axial direction so that they all lie in the same plane or they could be arranged at different distances, for example, one above another in the axial direction. For example, a closed end anode magnetron may have two slots arranged substantially at the mid-point of the anode in the axial direction with only a small distance between them. The tuning members may be able to intercept the same anode cavities or respective different ones. The tuning members may be moved in synchronism or independently and could all be of the same material or, for example, one might be of metal whereas the other, or others, are of a dielectric material.

BRIEF DESCRIPTION OF THE DRAWINGS

Some ways in which the invention may be performed are now described by way of example with reference to the accompanying drawings in which.

DESCRIPTION THE PREFERRED EMBODIMENTS

Figure 1:
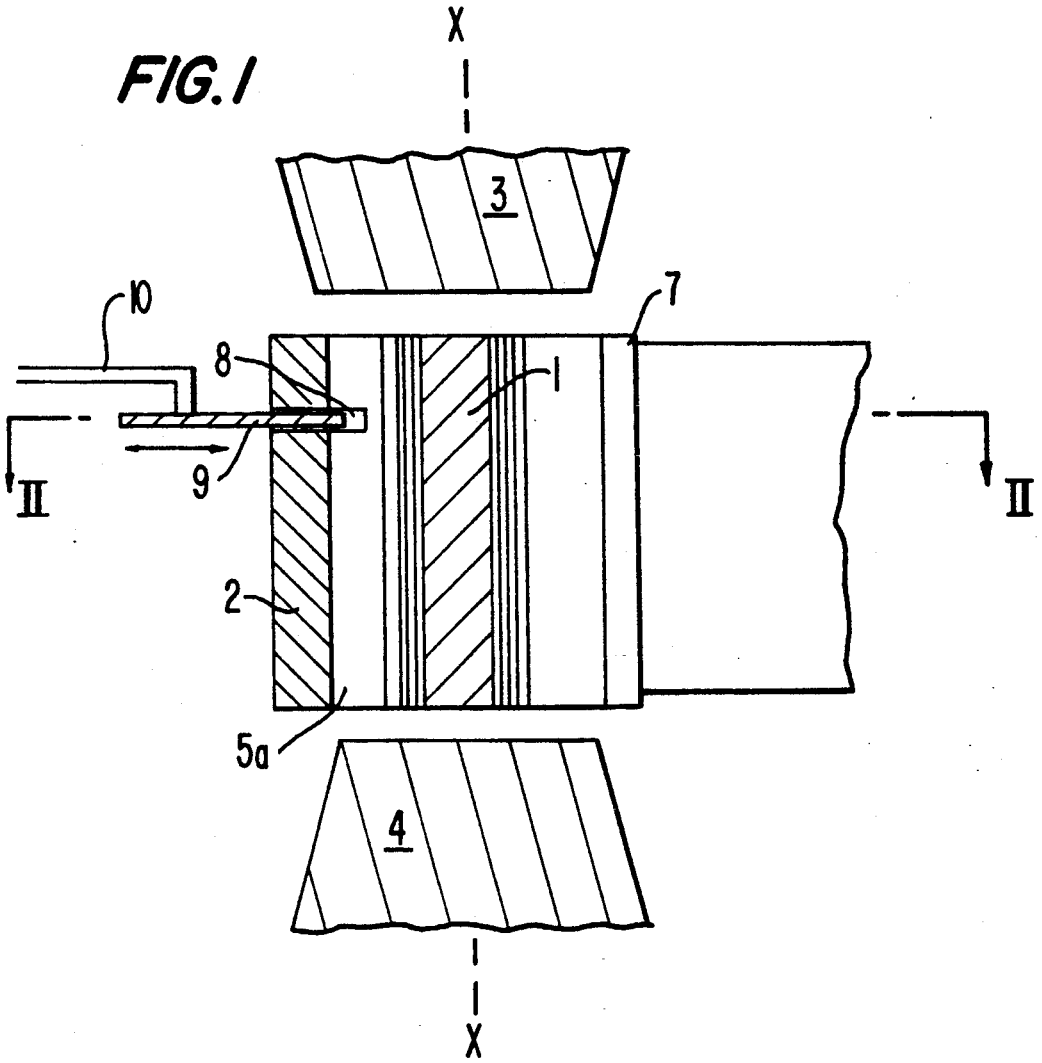
FIG. 1 is a schematic longitudinal section through a magnetron in accordance with the invention.
Figure 2:
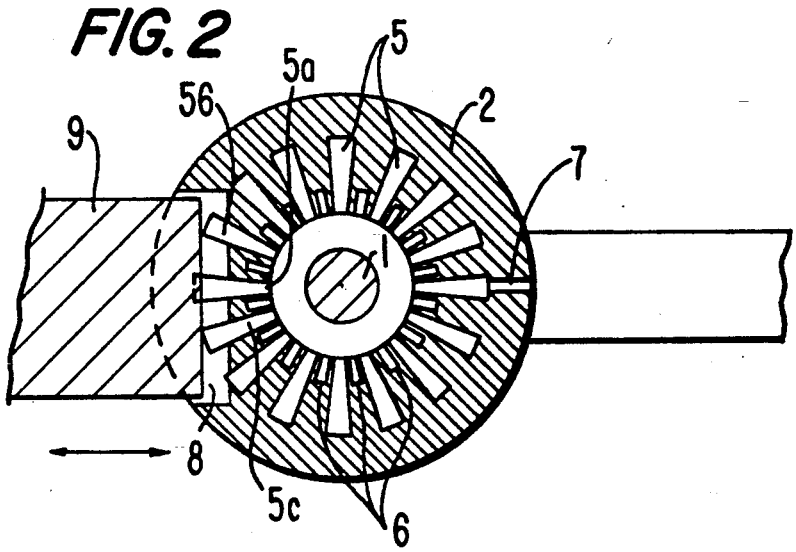
FIG. 2 is a view along the line II—II of FIG. 1.

With reference to FIGS. 1 and 2, a magnetron includes a cathode 1 surrounded by a cylindrical anode 2 arranged coaxially about a longitudinal axis X—X. Magnetic pole pieces 3 and 4 produce a magnetic field parallel to the longitudinal axis X-X in the interaction region of the device between the cathode 1 and anode 2. As best seen in FIG. 2, the anode 2 includes a plurality of anode cavities arranged in a rising sun configuration, having larger cavities 5 and cavities 6 between them with a smaller radial dimension, the larger cavities 5 having a radial length approximately three times that of the smaller cavities 6. A longitudinal output slot 7 in the anode 2 parallel to the axis X—X enables radiation to be coupled from the magnetron into an output waveguide.

A tuning slot 8 in the anode 2 is extensive in a plane orthogonal to the longitudinal axis X—X and parallel to the direction of current flow in the walls of the anode 2 defining the resonant cavities 5 and 6. The slot extends into the anode 2 to such an extent that it opens into the walls of three of the larger cavities 5 (see FIG. 2). A tuning member 9, which comprises a planar metal plate, is located in the slot 8 and is movable inwardly and outwardly in the direction indicated by the arrows by an actuator mechanism shown at 10 (see FIG. 1).

In the position illustrated, the tuning member enters only the central anode cavity 5*a* of the three it is capable of intercepting. If it is moved inwardly towards the cathode 1, a greater area of the cavity 5*a* is intercepted and the cavities 5*b* and 5*c* (see FIG. 2) are also entered by the metal tuning member 9. This causes the frequency of the generated radiation to be increased. By moving the tuning member 9 outwardly, the frequency is reduced.

Figure 3:
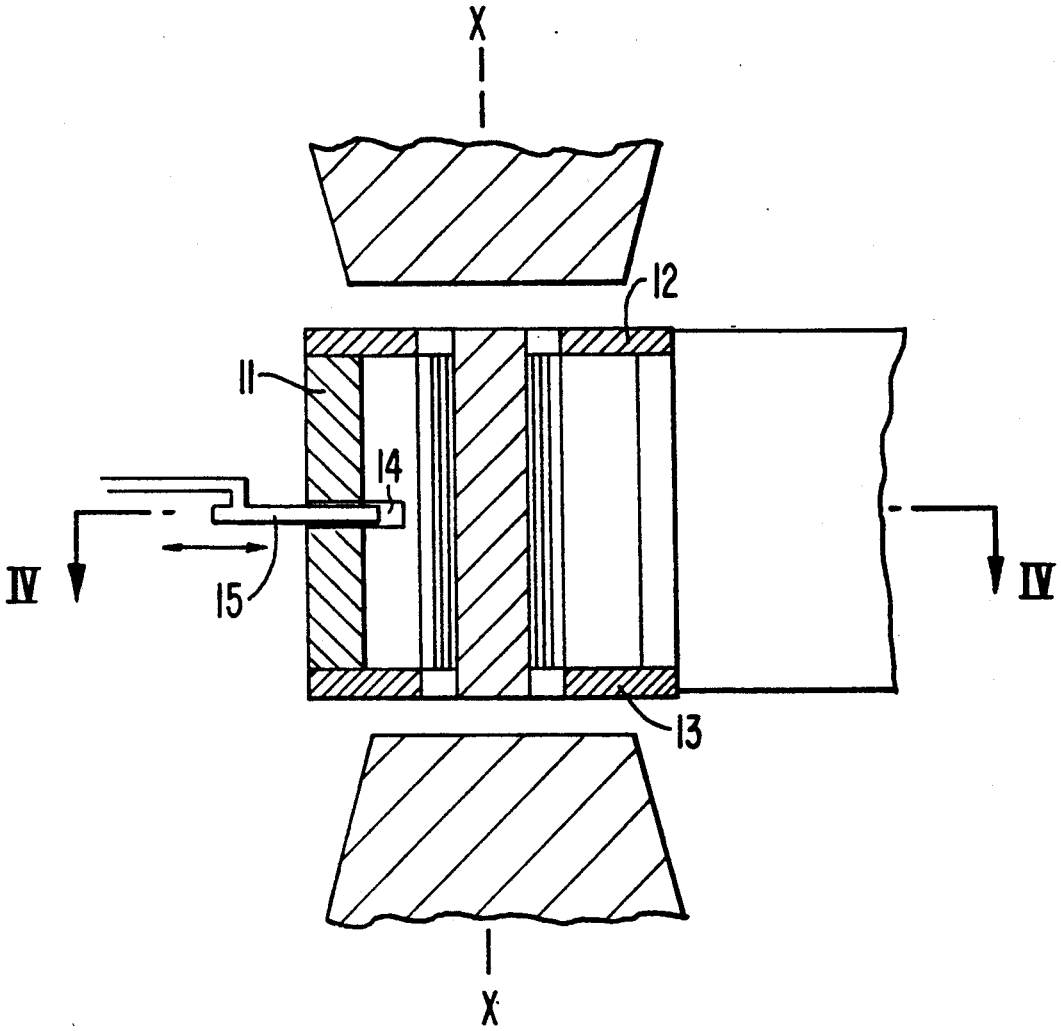
FIG. 3 is a schematic longitudinal section of another magnetron in accordance with the invention having a closed-end anode.
Figure 4:
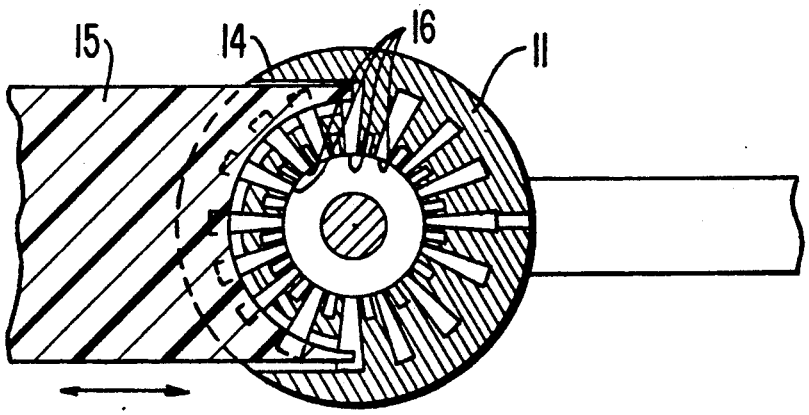
FIG. 4 is a view along the line IV—IV of FIG. 3.

With reference to FIGS. 3 and 4, a magnetron includes an anode 11 which is of a rising sun configuration and which is of the closed-end type, having two annular end plates 12 and 13 (see FIG. 3) fixed on either side of the anode 11 to further define the anode cavities. A slot 14 is located in the central transverse plane of the anode 11 orthogonal to the longitudinal axis X—X. A planar dielectric tuning member 15 is located in the slot and movable inwardly and outwardly to vary the frequency of the generated radiation. The leading edge of the tuning member 15 is curved as can be seen in FIG. 4. Thus, as the tuning member 15 is moved inwardly a plurality of the larger cavities 16 are entered by the tuning member at substantially the same time. As the magnetron is a closed-end anode device, the central plane in which the slot 14 is located is positioned at a voltage maximum and the current is a minimum, leakage through the tuning member 15 thus being extremely low. The dielectric material acts to lower the frequency as the tuning member 15 is pushed inwards towards the cathode.

Figure 5:
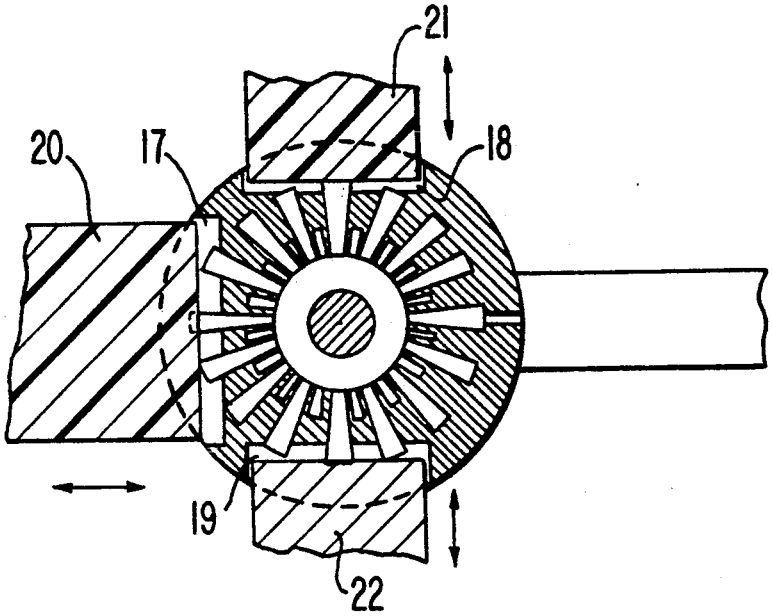
FIG. 5 schematically illustrates in transverse section another magnetron in accordance with the invention.

With reference to FIG. 5, another magnetron in accordance with the invention includes three slots 17, 18 and 19 which in this embodiment are located in a common plane which is orthogonal to the longitudinal axis. Tuning member 120, 21 and 22 are associated with slots 17, 18 and 19 respectively, and each member is movable independently from the others so as to give greater control over the frequency changes provided by their positioning. In this embodiment all the members are of dielectric material but two of them could be made of a dielectric material and the other could be a metal plate.

Figure 6:
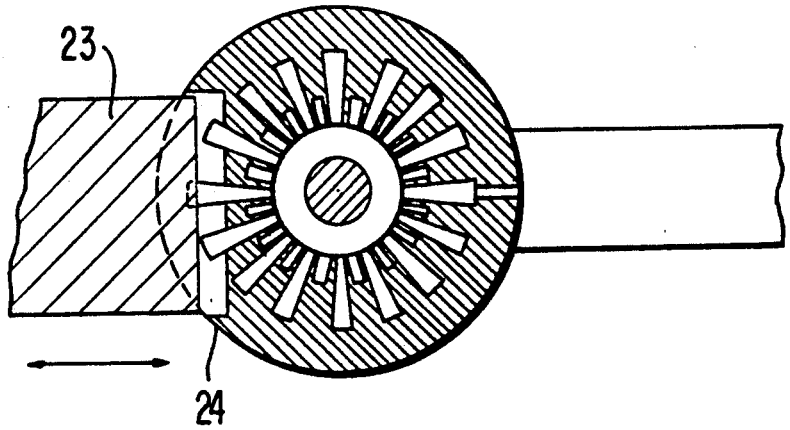
FIG. 6 is a schematic transverse section through a further magnetron in accordance with the invention.

FIG. 6 illustrates another magnetron in accordance with the invention in which one tuning member 23 is employed to provide frequency tuning. The anode is of the rising sun type and includes anode cavities having a radial dimension which depends on their positions relative to the slot 24.

I claim:

1. A magnetron for generating radiation at a predetermined frequency comprising:

a cathode having a longitudinal axis;

a cylindrical anode coaxially surrounding said cathode, said anode having first and second ends disposed along said longitudinal axis;

first and second sets of anode cavities disposed radially within said cylindrical anode and distributed circumferentially about said longitudinal axis between the first and second ends of said anode, each cavity of said second set of anode cavities being interposed between adjacent cavities of said first set and having a length in the radial direction which is shorter than respective lengths associated with the adjacent cavities of said first set; and a tuning slot disposed in the anode, said tuning slot extending in a plane substantially orthogonal to said longitudinal axis; and a tuning member comprised of a dielectric material movable within said tuning slot so as to protrude into at least two cavities of said first set of cavities and which does not protrude into any cavity of said second set of cavities, said tuning member protruding into said tuning slot by an amount which results in radiation being generated by said magnetron at said predetermined frequency.

2. A magnetron as claimed in claim 1 where said anode is provided with extraction means extending along said longitudinal axis for extracting output radiation from said magnetron; and wherein the tuning slot is located in the part of the anode diametrically opposite said extraction means.

3. A magnetron as claimed in claim 2 wherein said extraction means is an output slot.

4. A magnetron as claimed in claim 1 wherein the respective length of each cavity of said first set of anode cavities is approximately three times longer in the radial direction thereof than the length of each cavity of said second set of anode cavities.

5. A magnetron as claimed in claim 1 wherein the radial length of each of said anode cavities is determined by the circumferential position of the corresponding cavity about said longitudinal axis as measured from the position of said tuning slot.

6. A magnetron as claimed in claim 5 wherein the radial lengths of the anode cavities of said first set into which said tuning member protrudes are longer than the radial lengths of the remaining cavities of said first set.

7. A magnetron as claimed in claim 1 wherein the tuning member comprises a planar plate having a concave leading edge.

8. A magnetron as claimed in claim 1 wherein the first and second ends of said anode are open, said magnetron being of the open-end type.

9. A magnetron as claimed in claim 1 further comprising first and second end plates covering the first and second ends of said anode, said magnetron being of the closed-end type.

10. A magnetron as claimed in claim 1 wherein said tuning slot is located in said anode at a position substantially midway between the first and second ends thereof.

11. A magnetron for generating radiation at a predetermined frequency comprising:

a cathode having a longitudinal axis;

a cylindrical anode coaxially surrounding said cathode, said anode having first and second sets of anode cavities disposed radially within said cylindrical anode and distributed circumferentially abut said longitudinal axis, each cavity of said second set of anode cavities being interposed between adjacent cavities of said first set and having a length in the radial direction which is shorter than respective lengths associated with the adjacent cavities of said first set; and a plurality of tuning slots disposed in the anode, each of said plurality of tuning slots extending in a corresponding plane which is substantially orthogonal to said longitudinal axis; and a plurality of tuning members, each of said tuning members being movable within a corresponding one of said tuning slots so as to protrude into at least one cavity of only said first set of cavities, each of said tuning members protruding into the corresponding tuning slot by an amount which results in radiation being generated by said magnetron at said predetermined frequency.

12. A magnetron as claimed in claim 11 wherein all of said tuning slots extend in substantially the same plane orthogonal to the longitudinal axis.

13. A magnetron as claimed in claim 11 wherein each of said plurality of tuning members is movable independently of the other tuning members.

14. A magnetron as claimed in claim 11 wherein said plurality of tuning members comprises three tuning members, and wherein two of said tuning members are made of a dielectric material and one is a metal plate.

15. A magnetron as claimed in claim 11 wherein each of said plurality of said tuning members is made of a dielectric material.

* * * * *

UNITED STATES PATENT AND TRADEMARK OFFICE

CERTIFICATE OF CORRECTION

PATENT NO. : 5,182,493
DATED : January 26, 1993
INVENTOR(S) : Mark A. Robertson

It is certified that error appears in the above-indentified patent and that said Letters Patent is hereby corrected as shown below:

On the Title page, item [30] Under Foreign Application Priority Data, insert --Feb. 6, 1990 [GB] United Kingdom.....9002593.3 --.

Signed and Sealed this

Twenty-first Day of December, 1993

*Attest:*

Bruce Lehman

BRUCE LEHMAN

*Attesting Officer*

*Commissioner of Patents and Trademarks*